US012276168B2

(12) United States Patent
St George et al.

(10) Patent No.: US 12,276,168 B2
(45) Date of Patent: Apr. 15, 2025

(54) WELLBORE SATELLITE LAUNCHER SYSTEM

(71) Applicant: Isolation Equipment Services Inc., Red Deer (CA)

(72) Inventors: Ed St George, Red Deer (CA); Boris P Cherewyk, Red Deer (CA)

(73) Assignee: Isolation Equipment Services Inc., Red Deer (CA)

( * ) Notice: Subject to any disclaimer, the term of this patent is extended or adjusted under 35 U.S.C. 154(b) by 0 days.

(21) Appl. No.: 18/531,342

(22) Filed: Dec. 6, 2023

(65) Prior Publication Data

US 2024/0183238 A1 Jun. 6, 2024

Related U.S. Application Data

(60) Provisional application No. 63/430,871, filed on Dec. 7, 2022, provisional application No. 63/430,456, filed on Dec. 6, 2022.

(51) Int. Cl.
*E21B 23/08* (2006.01)
*E21B 23/04* (2006.01)
*E21B 23/06* (2006.01)

(52) U.S. Cl.
CPC ..... *E21B 23/0419* (2020.05); *E21B 23/06* (2013.01)

(58) Field of Classification Search
CPC ..... E21B 23/08; E21B 23/00
USPC ..... 166/75.15, 153
See application file for complete search history.

(56) References Cited

U.S. PATENT DOCUMENTS

| | | | | |
|---|---|---|---|---|
| 6,044,905 | A * | 4/2000 | Harrison, III | E21B 41/02 166/70 |
| 6,182,765 | B1 * | 2/2001 | Kilgore | E21B 23/14 166/381 |
| 10,605,037 | B2 * | 3/2020 | Eitschberger | E21B 23/08 |
| 11,434,725 | B2 * | 9/2022 | Eitschberger | E21B 23/10 |

* cited by examiner

*Primary Examiner* — Kenneth L Thompson
(74) *Attorney, Agent, or Firm* — Troutman Pepper Locke LLP

(57) ABSTRACT

A satellite launcher having a body comprising a planar surface and an axial bore; a plurality of satellite tubes, each satellite tube for releasably retaining a satellite and having an open end for facing the planar surface; a first and a second track system, each comprising: a track extending along the planar surface through the axial bore with a track opening at the axial bore, a magazine slideably attached to the track, the magazine for detachably retaining satellite tubes, and a drive system for moving the first magazine along the first track. The track of the second track system angularly offset from the track of the first track system relative to the axial bore, the second track defining a second track opening at the axial bore. When one of the satellite tubes is aligned with the axial bore, the satellite contained therein is free to drop out.

20 Claims, 9 Drawing Sheets

WELLBORE SATELLITE LAUNCHER SYSTEM

CROSS REFERENCE TO RELATED APPLICATION

This application claims priority to U.S. Provisional Patent No. 63/430,456 filed on Dec. 6, 2022 and U.S. Provisional Patent No. 63/430,871 filed on Dec. 7, 2022, the entirety of which are incorporated herein by reference.

FIELD OF THE DISCLOSURE

The present disclosure relates generally to wellbore satellite launchers, and in particular to wellbore satellite launchers using magazines moveable along tracks.

BACKGROUND

U.S. Pat. No. 9,103,183 to Vetco Gray Inc. discloses a ball launcher for dispatching balls into a wellbore that includes a manifold for selective attachment to a wellhead assembly and a magazine mounted on the manifold in which the balls are stored for distribution to the manifold. Chambers are provided in a cylinder in the magazine, so that by rotating the cylinder the chambers register with a bore in the manifold, through which the balls are delivered to the wellbore. Flowing a flushing fluid into the bore in the manifold urges the balls downward. An auxiliary line through the manifold provides a conduit for the flushing fluid into the bore.

U.S. Pat. No. 10,947,806 to Stonewall Energy Corp. discloses a sleeve and plug launcher for launching a sleeve and plug down an oil or gas well includes sleeve and plug holders, a support plate beneath the open bottoms of the sleeve and plug holders, an aperture positioned in the support plate and a sleeve and plug discharge connectable to a well head of a well and positioned below the aperture. When one of the sleeve and plug holders stops over the aperture in the support plate, a sleeve and plug in the sleeve and plug holders drops through the aperture and is directed into a wellhead by the sleeve and plug discharge.

There remains a need for a safe, efficient and remotely operated apparatus and mechanism for introducing or deploying including balls, elongated downhole actuators, and/or the like to a wellbore for applications such as multi-stage fracturing pumping stimulations.

SUMMARY

Embodiments disclosed herein relate to a satellite launcher having one or more magazines sliding along a track, each magazine comprising one or more satellite tubes for releasably retaining satellites. Embodiments disclosed herein provide efficient loading, as well as safe and precise operation for injecting satellites into wellbores.

In a broad aspect of the present disclosure, a satellite launcher for delivering satellites into a wellbore comprises a body comprising a planar surface and an axial bore extending through the planar surface, the axial bore in communication with the wellbore; a plurality of satellite tubes, each satellite tube for releasably retaining a satellite and having an open end for facing the planar surface; a first track system comprising: a first track extending along the planar surface through the axial bore, the first track defining a first track opening at the axial bore, a first magazine slideably attached to the first track and movable along the first track, the first magazine for detachably retaining two or more of the satellite tubes, and a first drive system for moving the first magazine along the first track; and a second track system comprising: a second track extending along the planar surface through the axial bore, wherein the second track is angularly offset from the first track relative to the axial bore, the second track defining a second track opening at the axial bore, a second magazine slideably attached to the second track and moveable along the second track, the second magazine for detachably retaining two or more of the satellite tubes, and a second drive system for moving the second magazine along the second track, wherein when one of the satellite tubes is aligned with the axial bore, the satellite contained therein is free to drop out of the satellite tube.

In some embodiments, the satellite launcher further comprises a deployment system between the satellite launcher and the wellbore, the deployment system comprising a first actuator to selectively allow a satellite from a satellite tube to enter the wellbore.

In some embodiments, the deployment system comprises a second actuator to selectively allow a satellite having passed the first actuator to enter the wellbore.

In some embodiments, the deployment system further comprises a small pressure pump for equalizing pressure between the deployment system and the wellbore.

In some embodiments, the first track system and the second track system each comprise a guide rail for assisting the retention of satellite tubes.

In some embodiments, the first track system and the second track system each comprise a frame structure for assisting the retention of satellite tubes.

In some embodiments, the frame structures each comprise a safety assembly comprising a blanking cap.

In some embodiments, the first magazine comprises a first carrier and the second magazine comprises a second carrier for supporting satellite tubes.

In some embodiments, the first drive system and the second drive system are screw drives, each screw drive comprising a hydraulic screw actuator, an activation nut and a threaded axle.

In some embodiments, the first drive system and the second drive system are screw drives, each screw drive comprising a hydraulic screw actuator, a hydraulic motor and a threaded axle, wherein the hydraulic motor comprises a hydraulic stop valve operative to stop a flow of hydraulic fluid to the hydraulic motor.

In some embodiments, the first drive system and the second drive system comprise one or more sensors to confirm travel of the magazine along the track.

In some embodiments, the sensors measure and record revolutions of the threaded axle.

In some embodiments, the first drive system and the second drive system are one of chain and sprocket drives, winch and cable drives, hydraulic cylinder drives, and gear rack drives.

In some embodiments, the first track system and the second track system each comprise a spring pin stop for stopping a magazine at positions along the corresponding tracks corresponding to positions where a satellite tube is aligned with the axial bore.

In some embodiments, the satellite tubes are comprised of translucent plastic material.

In some embodiments, the plastic material is thermally insulative.

In some embodiments, each of the satellite tubes comprise a heating coil.

In some embodiments, the satellite launcher further comprising a drop sensor to confirm that a satellite has been provided to the wellbore.

In some embodiments, the satellite tubes comprise a cap on an end distal the planar surface.

In some embodiments, the satellites are at least one of darts and packer balls.

BRIEF DESCRIPTION OF THE DRAWINGS

For a more complete understanding of the disclosure, reference is made to the following description and accompanying drawings, in which.

DETAILED DESCRIPTION

Embodiments disclosed herein are discussed in the context of the actuation of a series of satellites such as darts, packer balls, and/or the like within a wellbore for isolating subsequent zones within a formation for fracturing of the zones. A series of packers typically uses a series of different sized darts and/or balls for sequential blocking of adjacent packers. One of skill in the art however, would appreciate that some of the embodiments disclosed herein are applicable to any operation requiring the dropping of one or more darts and/or balls in the wellbore.

Satellites such as darts and/or balls have been dropped from surface through a tubular in the wellbore into a seat of a downhole tool for blocking flow and permitting changed in pumped pressure to actuate downhole equipment such as movement of a sliding sleeve, opening and closing of a port, movement of a valve, fracturing of a frangible element, release of cementing wiper plugs, control of downhole packers, sealing perforations and/or the like. The dimensions of a satellite and the sequence of release of the one or more satellites is relevant to actuation of a series of packers for operations, which can include applications such as fracturing, acid stimulation, and stimulation procedures directed to zones of interest within the formation surrounding the wellbore.

Figure 1:
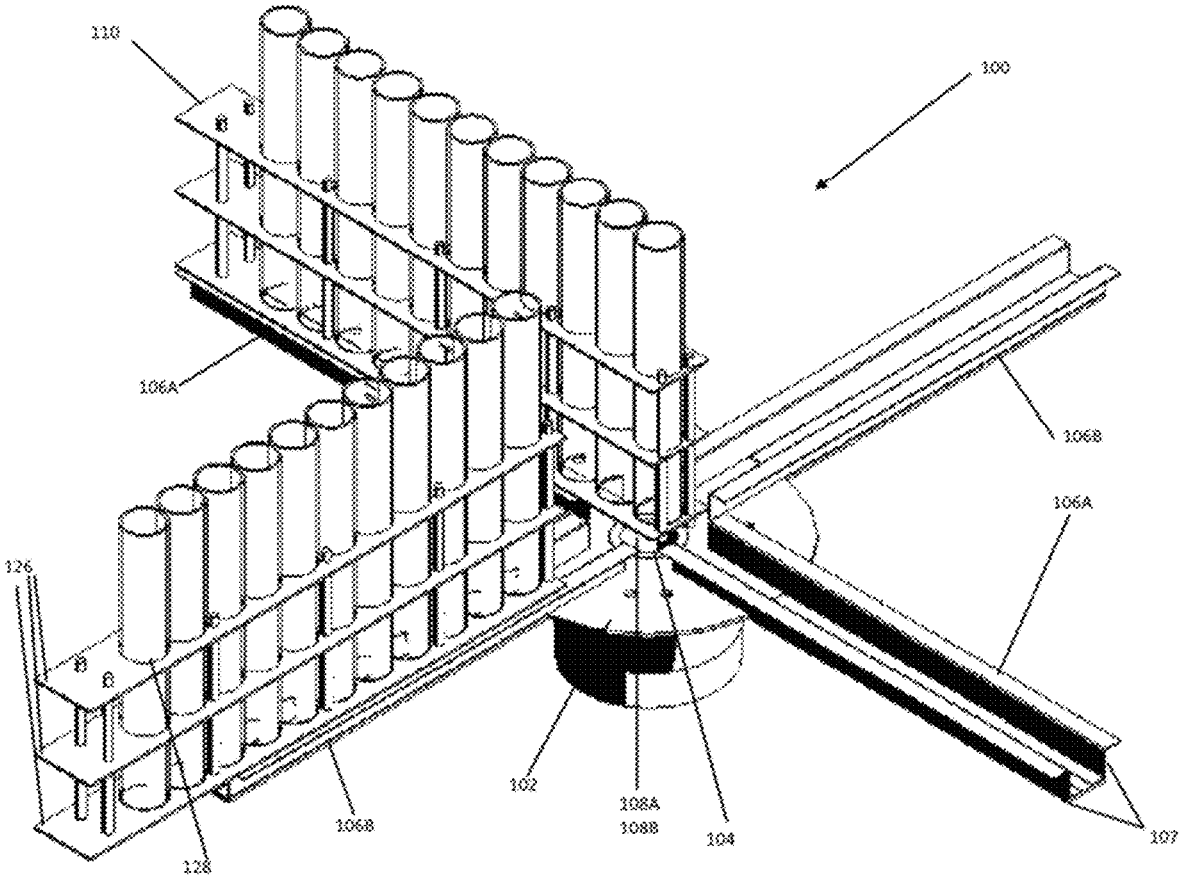
FIG. 1 is perspective view of a portion of an embodiment of a ball launcher.
Figure 2:
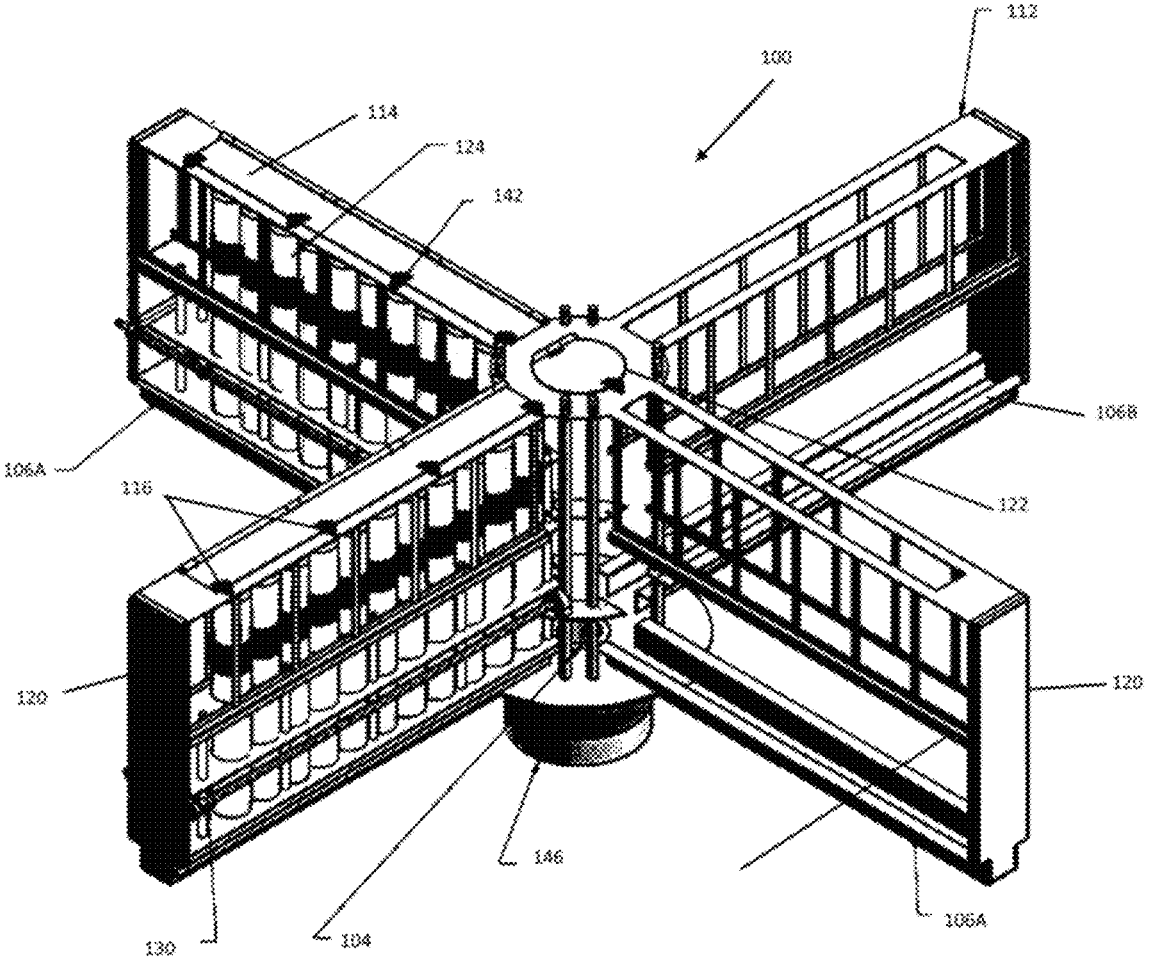
FIG. 2 is perspective view of a portion of an embodiment of a ball launcher having magazine cages.

Referring to FIG. 1, an embodiment of a satellite launcher 100 for delivering satellites, such as darts, packer balls, and/or the like, comprises a planar surface 102 and an axial drop bore 104 defined therein. The axial bore 104 going through the planar surface 102 and in communication with the wellbore or a component of the satellite launcher 100 located towards the wellbore relative to the planar surface 102. The planar surface 102 may be any appropriate shape such as rectangular, circular, and/or the like or may be of an irregular shape with cut-outs. The satellite launcher 100 further comprises one or more tracks 106A and 106B on the planar surface 102 and may be attached thereto. The tracks 106A and 106B may be generally arranged to cross the axial bore 104, wherein the tracks 106A and 106B define a track opening 108A and 108B proximate the axial bore 104 such that the tracks 106A and 106B do not cover or otherwise obstruct the axial bore 104. In embodiments comprising more than one track, the tracks 106A and 106B are generally arranged angularly offset relative to one another relative to the axial bore 104, with their associated track openings 108A and 108B intersecting proximate the axial bore 104. Each track 106A and 106B is a component of track system further comprising a carrier or magazine 110 slideably attached to the track 106A and 106B, wherein the magazine 100 is free to move along the longitudinal aspect of the track 106A and 106B but is generally retained within the track 106A and 106B such that it does not readily tip across the track 106A and 106B. The track 106A and 106B may comprise a groove deep enough to cooperate with the magazine and have adequate dimensions to provide this function or the magazine 110 may comprise one or more protrusions to slidingly cooperate with one or more grooves in the tracks 106A and 106B, or vice-versa. Referring to FIG. 2, in some embodiments, the track system comprises a frame structure 112 for providing further support to retain the magazine 110 within the frame structure 112. The frame structure 112 may comprise a number of pieces and may form a cage, box, enclosure and/or the like. The frame structure 112 may comprise a top having a openable flap 114, which may have one or more locking mechanisms 116. In some embodiments, the frame structure 112 comprises guide rails 118 and an openable end cap 120 to prevent magazines 110 from sliding off the tracks 106A and 106B. The frame structure 112 may also comprise a safety assembly 122 generally located above and in alignment with the axial bore 104. The safety assembly 122 may be a removable cap comprising a robust material, such as metal or composite and/or a blank assembly. The safety assembly 122 may be removable to permit loading of a satellite tube 124 located thereunder, for example where satellite activation is not confirmed). The safety assembly 122 may be configured to break, burst, and/or the like at a specific pressure should a burst of pressure be introduced in intentionally where a satellite is contained.

Figure 3:
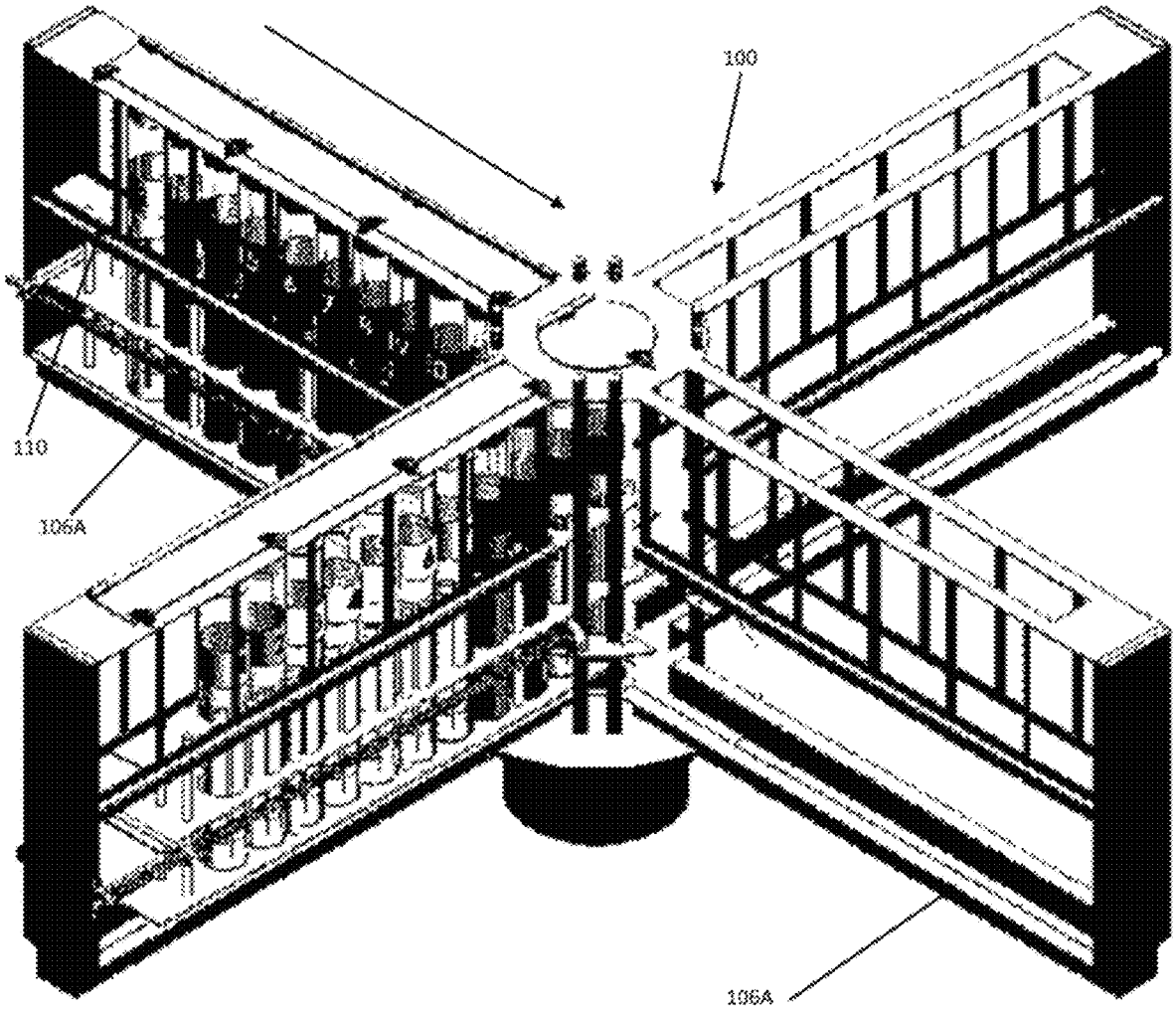
FIG. 3 and FIG. 4 are perspective views of a portion of the ball launcher of FIG. 2 showing movement of a first magazine.
Figure 4:
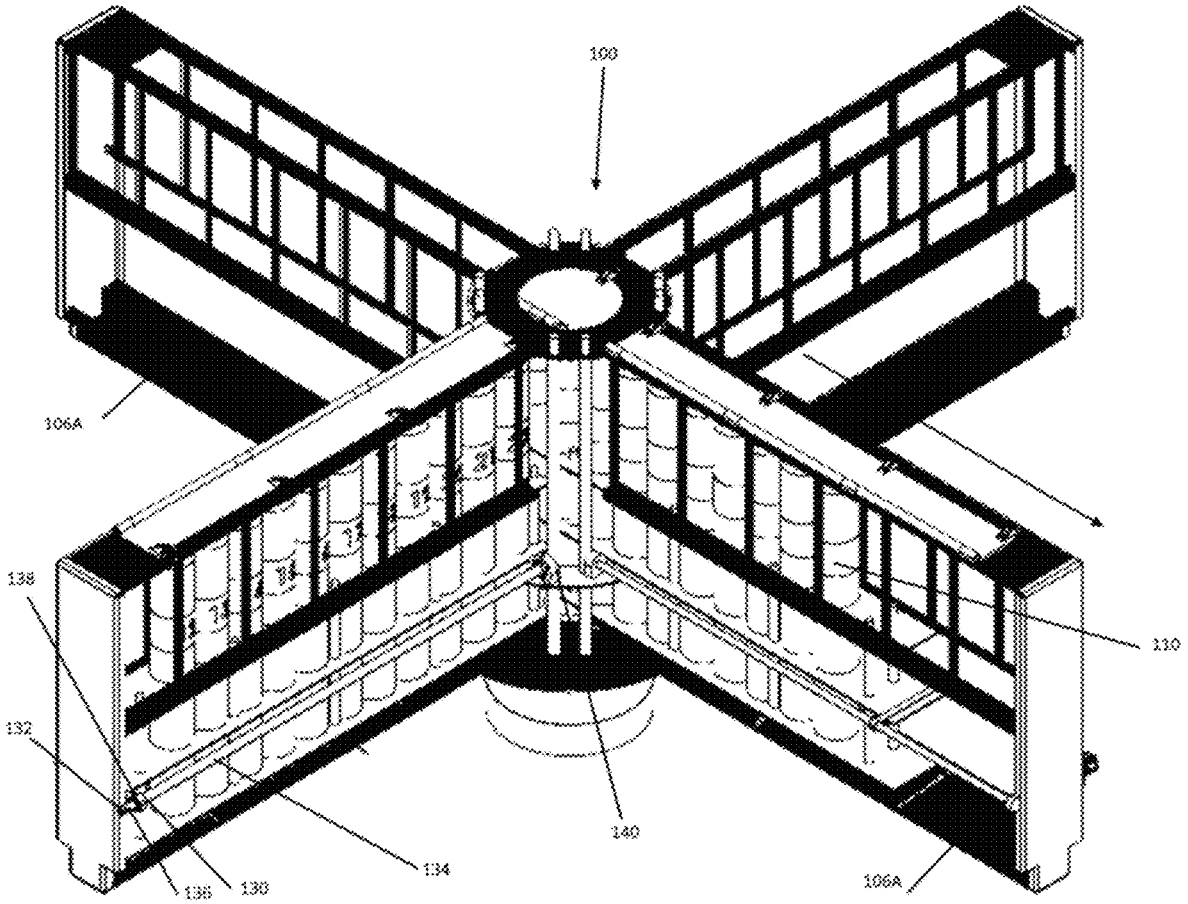
Figure 5:
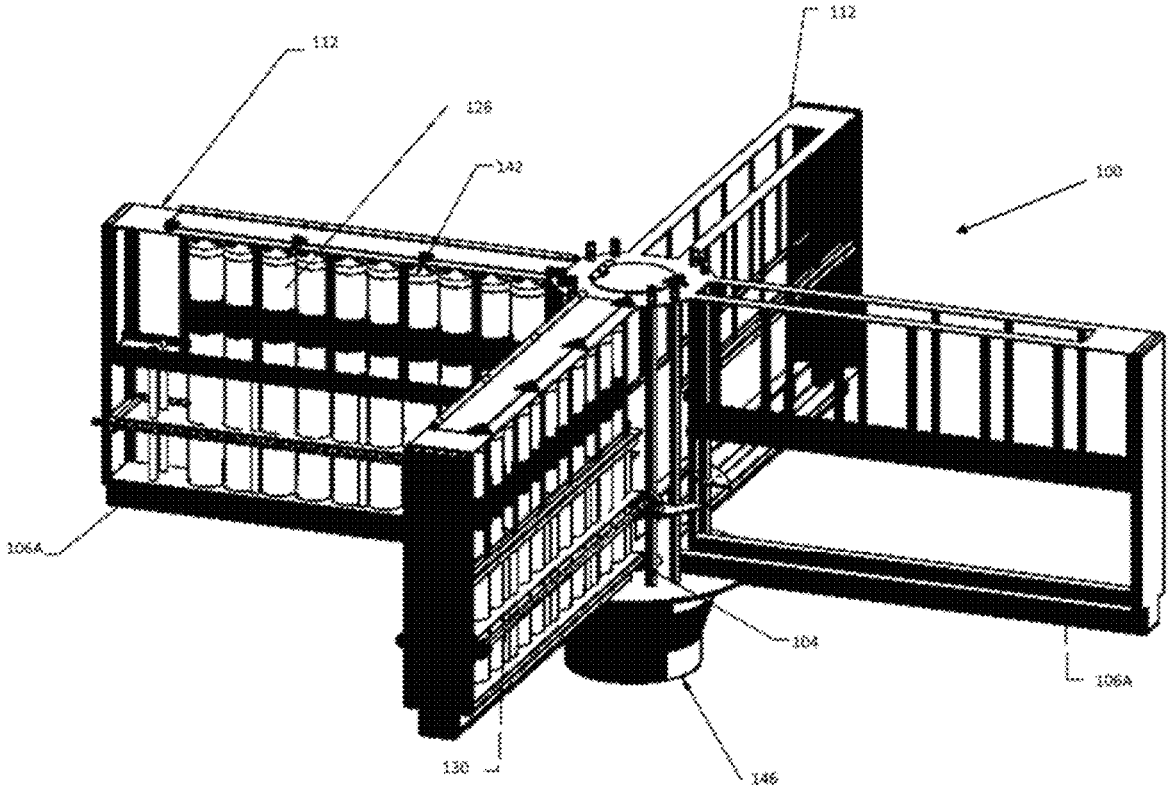
FIG. 5 is an alternative perspective view of the ball launcher of FIG. 2.

In some embodiments of the present disclosure, each of the magazines 110 are for detachably retaining one or more satellite tubes 124. In some embodiments, each magazine 110 comprises one or more planar members 126 having a plurality of openings 128, each opening 128 for receiving satellite tubes 124. Each of the magazines 110 may comprise more than one planar member 126, the planar members 126 vertically spaced apart to provide lateral support to the satellite tubes 124. The tracks 106A and 106B and magazines 110 are generally dimensioned and arranged such that each portion of a track 106A and 106B extending away from the axial bore 104, and separated by a track opening 108A and 108B can receive an entire magazine 110, such that the magazine 110 may be positioned to not obstruct the axial bore 104. More specifically, each track 106A and 106B may be manufactured and provided as either a single piece with an integrated opening or in two or more pieces assembled into an integrated structure. In all cases, walls 107 of the tracks 106A and 106B are continuous such that a magazine 110 can readily traverse from one side of the axial bore 104 to the other while engaging walls of the tracks 106A and 106B. One portion of a track 106A and 106B may be designated a load track portion, where a magazine 110 comprising satellite tubes 124 loaded with satellites for injection is generally located, and another portion as a receiving track portion where magazines 110 are placed after satellites have been injected. More specifically, both the load track portion and the receiving track portion are of sufficient length to have a magazine 110 thereon without covering the axial bore 104. The track 106A and 106B and portions thereof, including the load track portion and the receiving track portion, are supported by the planar surface 102. Referring to FIG. 3 and FIG. 4, a magazine 110 is shown moving along a track 106A from a load track portion in FIG. 3 to a receiving track portion in FIG. 4.

In some embodiments comprising two tracks 106A and 106B, the satellite launcher 100 may configured to launch up to, for example, 26 or 35 darts, balls, and/or the like. The magazines 110 may be configured for one size of darts, balls, and/or the like or any combination of different sizes. Darts and satellite tubes 124 may be colour coded and/or numbered for quick identification.

For the operation of satellite launchers 100 comprising two or more magazines 110, while one magazine 100 is being used to deploy satellites, the other magazine 110 may be loaded or reloaded. Reloading may occur while the satellite tubes 124 remain in their position within the magazines 110 by dropping satellites therein.

Each of the track systems further comprises a drive system 130 for moving the magazine 110 along the track 106A and 106B. In some embodiments, the drive system 130 is a screw drive comprising a hydraulic screw actuator 132, an activation nut 136 and a threaded axle 134. Alternatively, the drive system 130 may comprise a hydraulic motor 138 in lieu of the activation nut 136, which hydraulic motor 138 may comprise a hydraulic stop valve operative to stop a flow of hydraulic fluid to the hydraulic motor 138. In some embodiments, the drive system 130 comprises one or more sensors 140 to confirm the travel of the magazine 110 along the track 106A and 106B. In some embodiments, the one or more sensors 140 may precisely measure and record the number revolutions of the threaded axle 134 to determine said travel. The number of rotations and distance travelled will depend characteristics of the satellites and/or drive system 130. For example, in some embodiments, 30 rotations may correspond to 5.0 inches of travel. The one or more sensors 140 may connect to an application or app in a user device, providing the device with data, which may be displayed as percentages that a satellite is close to a desired position. The application or app in a user device may also be used to operate the satellite launder 100 including the drive system 130, which may further comprise stop pins. The application or app may also display initial activation of the satellite launcher 100, position or movement of the satellite launcher 100 and elements thereof, and/or the satellite tube 124 being deployed. A timer may also be used to confirm time to travel for a satellite, for example measured in seconds. In other embodiments, the drive system 130 may be a chain and sprocket drive, a winch and cable drive, a hydraulic cylinder drive, and gear rack drive. In some embodiments, a gear rack drive comprises a gear drive and a gear pinion. The gear rack comprises same sized and shaped teeth at equal distances along a flat surface or a straight rod. The gear pinion may be cylindrical for converting rotational movement from an actuator into linear motion along or of the gear rack.

The satellites tubes 124 are for securely retaining satellites such as darts, packer balls, and/or the like prior to injection into the wellbore. In some embodiments, the satellite tubes 124 are comprised of translucent plastic material, allowing an operator and/or sensor to readily detect the presence of a satellite. While a plastic material is described, a person of skill would appreciate that any translucent suitable material could be used. Further, a person of skill would appreciate that any material, including an opaque material could be used, but may affect visibility of satellites in satellite tubes 124.

In embodiments where satellites are darts, the darts may be of any size and dimension but in some embodiments, the darts, including the dart body and sealing material, are 4" darts with an outside diameter of 3.6" or 5" darts with an outside diameter of 4.5" and having lengths about from 13" to 28. The darts may be many different types, including programmable darts, wherein a dart may be programmed along with packers set up downhole such that one or several packers may be activated as the programmable darts pass through to activate one or multiple stages of a wellbore. The dart may also be a mechanical dart, which activates one packer to activate one stage at a time.

Satellite tubes 124 generally provide protection to the dart, ball, and or the like from external environments elements such as rain, snow, hail, ultraviolet waves, wind, and/or the like. In embodiments where the satellite tube 124 is comprised of a plastic material, the satellite tube 124 provide thermal insulation as plastics generally do not absorb heat and have a low rate of thermal conduction. This may be important under colder operating temperatures. In some embodiments, the satellite tubes 124 further comprise a closure distal the wellbore, such as a cap 142, which may be permanently formed or removably attached to the satellite tube 124. In operation, the cap 142 may be removable for reloading satellites. Alternatively, to load a magazine 110, the satellite tubes 124 may be removed, the satellites are then placed on the magazine 110 and satellites tubes 124 replaced over the satellites. Generally, loading using the cap 142 may be safer as the loading of satellites may occur a distance from the surface, such as 15 to 20 feet from ground level, where a falling 30" plastic satellite tube 124 may pose safety hazards.

Figure 9:
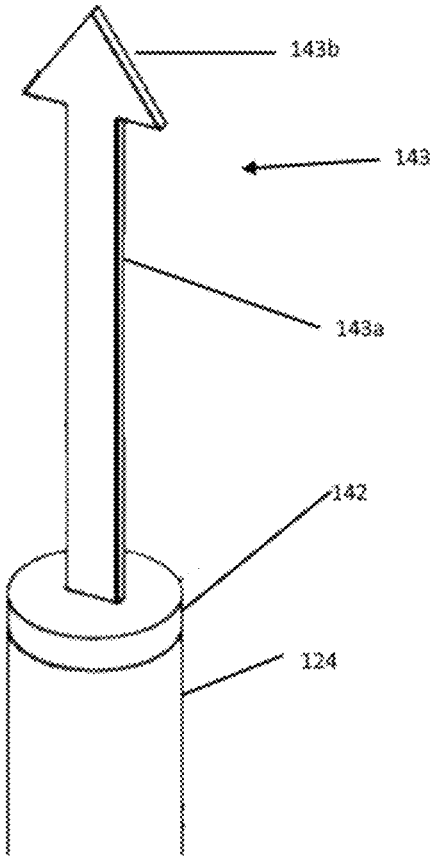
FIG. 9 is a partial detail view of an indicator of a satellite tube.

Referring to FIG. 9, in some embodiments, the satellite tubes 124 may comprise an indicator 143 for visually confirming whether a satellite has been deployed. In some embodiments, the indicator 143 comprises a rod 143*a* axially movable through the cap 142. A portion of the rod 143*a* may inside the satellite tube 124 with a member to act against a satellite such as a plate, acting like a piston, such that it stays up when a satellite is present and down when the satellite is not. The indicator 143 may further comprise a confirmation arrow 143*b* at the end of the rod 143*a* distal the planar surface 102 for further ease of confirmation. While an arrow is shown, a person of skill would appreciate that any design or shape could be used. Further, the rod 143*a* and/or arrow 143*b* may be colour coded and/or numbered for ease of identification.

In some embodiments, the satellite tubes 124 may comprise one or more heating elements 144 for maintaining the satellites tubes 124 at a higher temperature than surrounding ambient temperature. The heating elements 144 may be electrical-based, fluid-based, oil-based, and/or the like. In some embodiments, the heating elements 144 may be heating coils that operate like radiator coils, wherein hydraulic lines are heated, circulated through the heating elements 144 to maintain the higher temperature to keep the satellites from freezing. The heating elements 144 may be located around, within, or integrated with the satellite tubes 124. In some embodiments, the heating elements 144 are located at the bottom of the satellite tubes 124.

The satellite tubes 124 may be wider than the axial bore 104 such that when one of the satellite tubes 124 within a magazine 110 is aligned with the axial bore 104, the satellite contained therein is free to drop out of the satellite tube 124 and through the axial bore 104, while the satellite tube 124 is prevented from also going through the axial bore 104. The satellite tubes 124 do not need to secured to the magazine 110 but may be secured with a mechanism, such as with a ⅛ or ¼ turn, wherein the satellite tube 124 catches a small protruding pin in the magazine 110, locking it into place within the magazine 110, which may be used for transport.

In certain applications, the protection of satellites from external environmental elements or conditions is not required, or protection may be alternatively provided such as by a housing enclosure or a partial roof. In some embodiments, the satellites are placed on one or more of the tracks 106A and 106B without the use of either or both of the magazine 110 and the satellite tubes 124, and where a drive system 130 pushes, pulls or otherwise moves the satellites along the track. The satellites may be maintained on the one or more tracks 106A and 106B with the assistance of guide rails to prevent the satellites from falling off the sides. The satellites may be prevented from entering the axial bore 104 by an end restraint or barrier located proximate axial bore 104. A deployment mechanism may be used to move a satellite stopped at the end restraint into the axial bore 104. In some embodiments, the deployment mechanism may be an actuator having a two prong mechanism, a robotic arm, and/or the like. In embodiments where satellites are contained within tubes, the deployment mechanism may either leave the satellite tube 124 on the load track portion or move it along with the satellite onto the axial bore and remove it or place it on the receiving track portion after the satellite has entered the axial bore. A receiving track portion may not be required where satellite tubes 124 are not used.

In some embodiments, the satellite launcher 100 comprises drop sensor to confirm that a satellite has passed the axial bore 104. In embodiments where translucent components are used, this may operate through those translucent elements. In other embodiments, the drop sensor can be located within or proximate to the axial bore 104 to confirm the same.

In some embodiments, the track systems comprise spring pin stop mechanisms for temporarily restraining or stopping magazines at positions along the corresponding tracks corresponding to positions where a satellite tube 124 is aligned with the axial bore 104.

The axial bore 104 may be in direct communication with the wellbore. In some embodiments, the axial bore 104 may also be in connection with a deployment system 600. The satellite launcher may comprise an adapter 146 comprising an interchangeable sleeve to connect the axial bore 104 to the deployment system 600, such as a valve or remote valve. The adapter 104 allows the system to be used a variety of applications.

Figure 6:
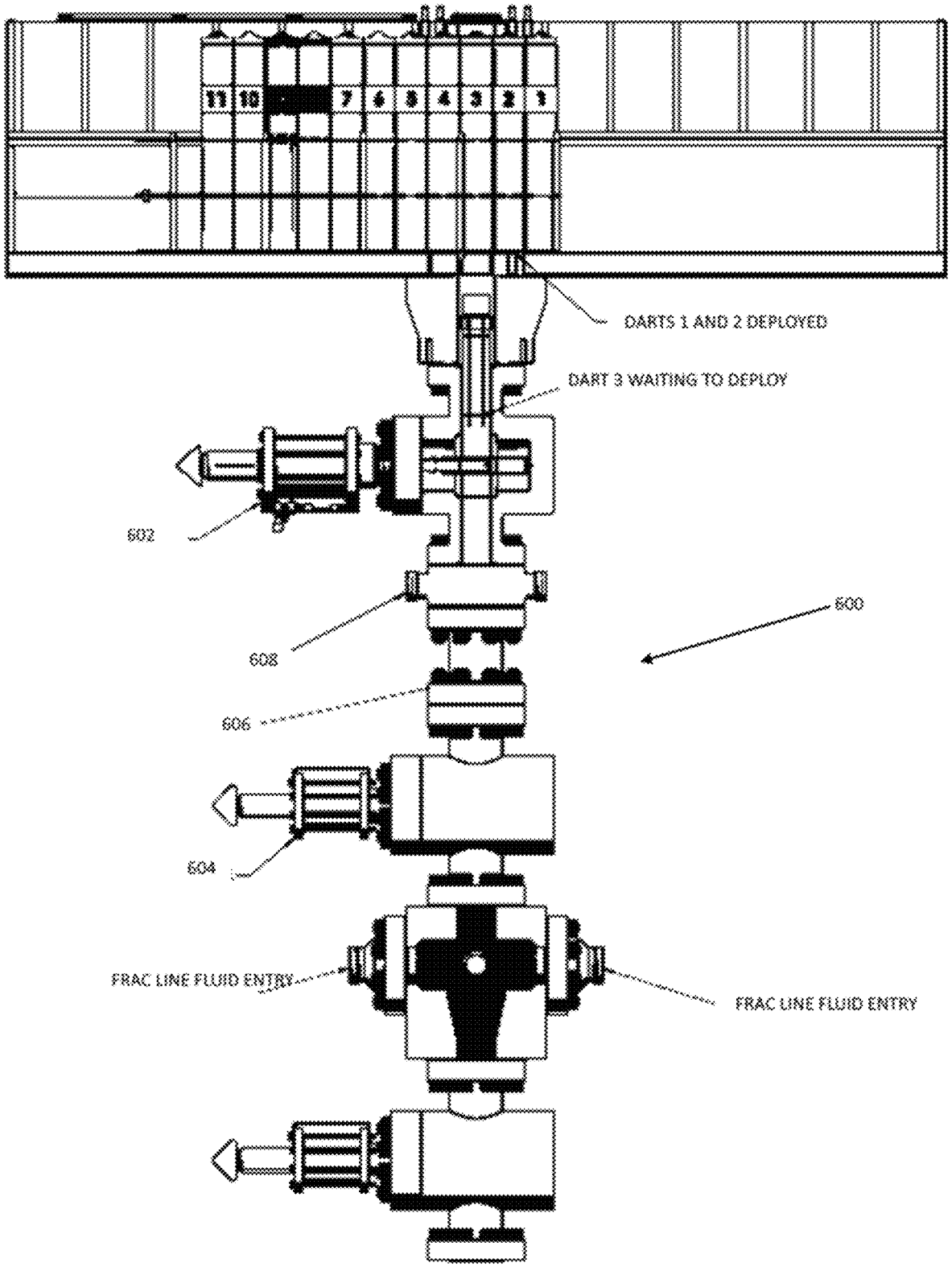
FIG. 6 is a side view of an embodiment of a ball launcher having a deployment system.

The deployment system 600 may comprise one or more actuators or gates to selectively allow a satellite from a satellite tube 124 to enter the wellbore. The actuators or gates may be remotely operable. Referring to FIG. 6, the deployment system 600 comprises a first remotely operable gate 602 (or upper or load remote) and a second remotely operable gate 604 (or launch remote) with a staging or dry block 606 therebetween. The staging block 606 may comprise a pressure pump 608 for equalizing pressure between the deployment system 600 and the wellbore. FIG. 6 shows a magazine wherein the first and second darts have been deployed with a third dart located at the upper remote actuator 602.

Figure 7:
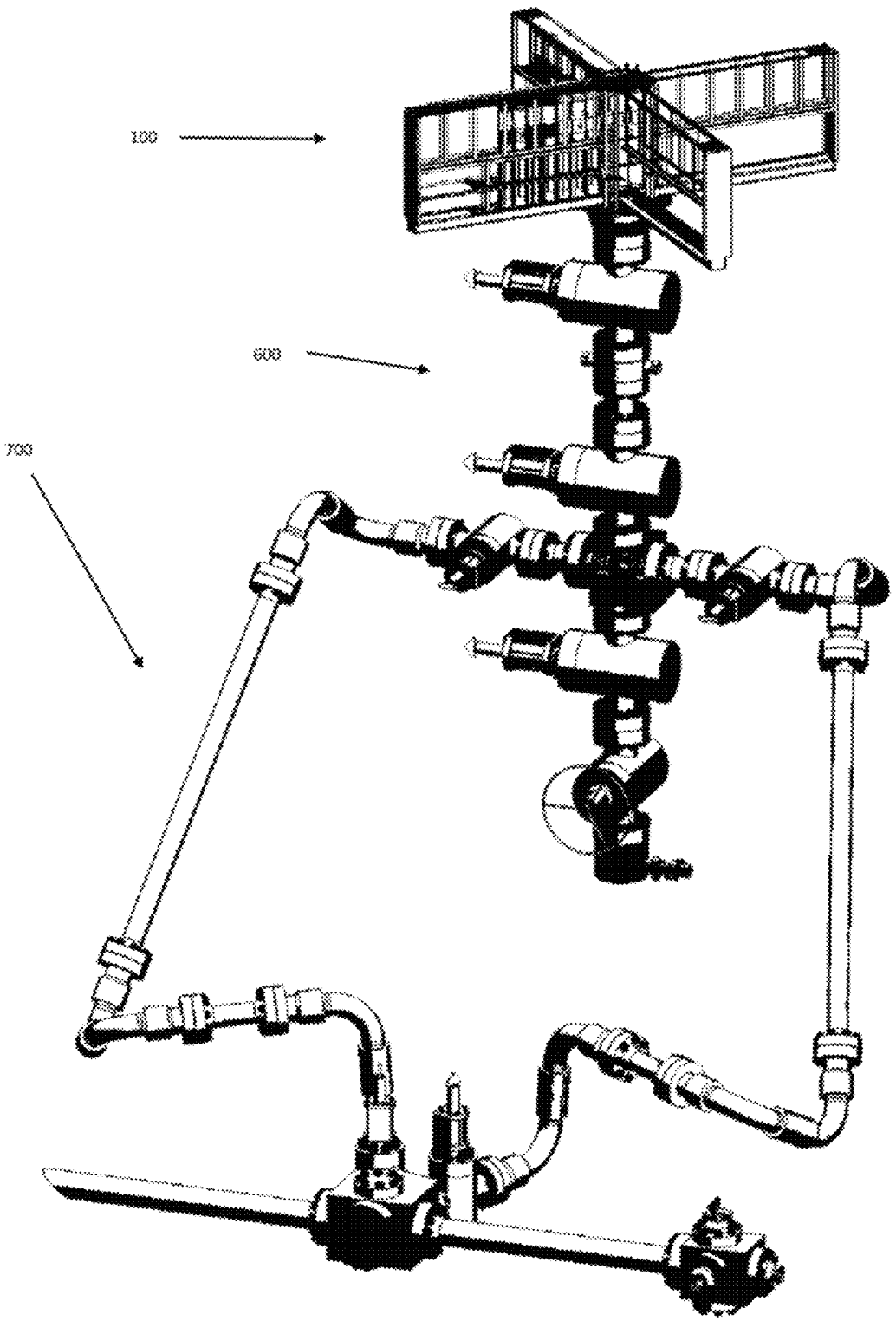
FIG. 7 is a perspective view of the ball launcher of FIG. 6 on a frac tree.
Figure 8:
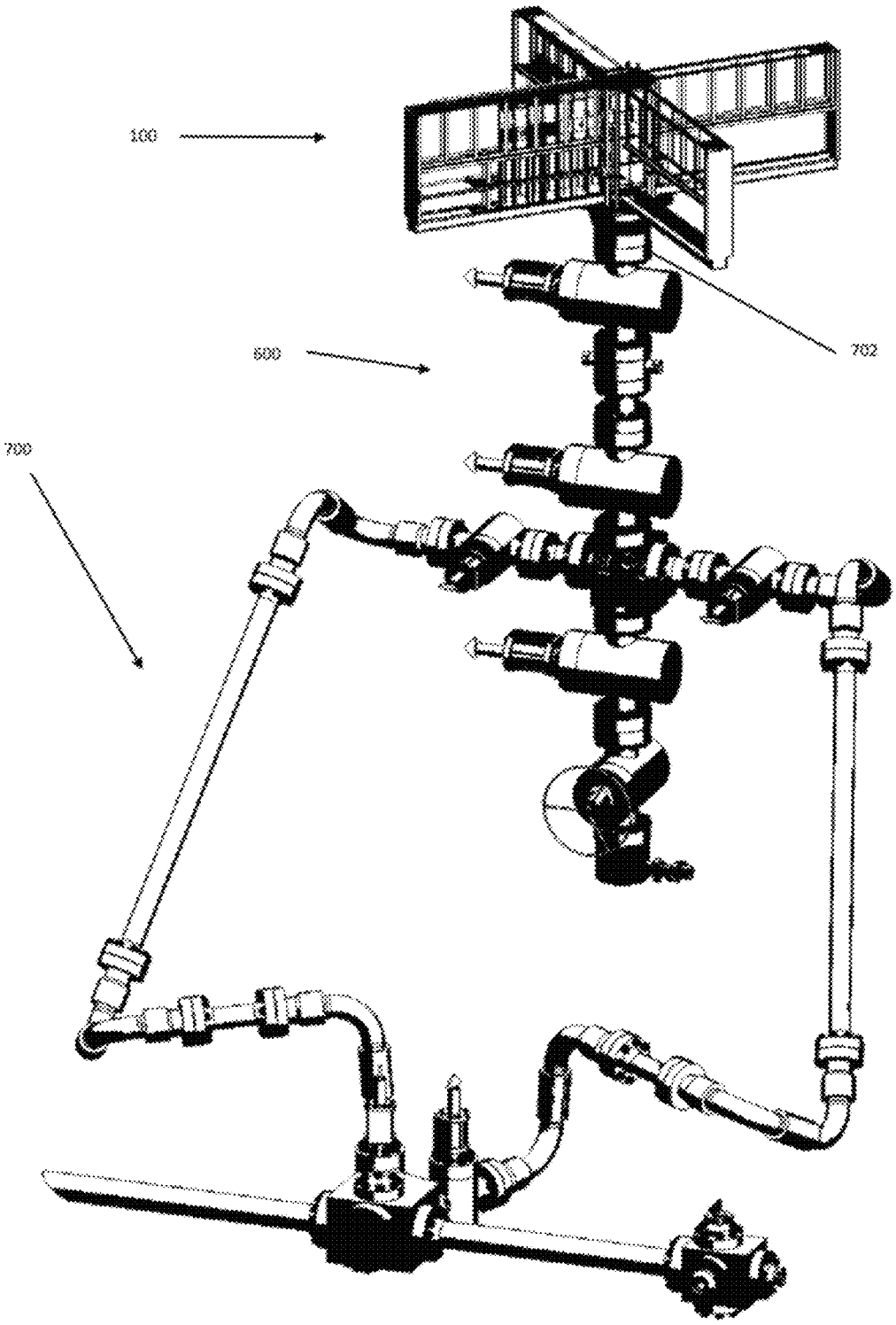
FIG. 8 is the ball launcher and frac tree of FIG. 7 with a vent.

FIG. 7 illustrates a frac tree 700 comprising the satellite launcher 100. FIG. 8 illustrates the frac tree 700 and satellite launcher 100 of FIG. 7 further comprising a relief vent 702 to reduce potential upward pressure on an empty satellite tube in certain circumstances. This may be the result of a variety of circumstances, including human error and mechanical hydraulic failure. In addition, the upper remote 602, when lubricated, can trap pressure therein, which is then released when the deployment system 600 valve is opened. The deployment system 600 functions as "fail open", which is important in the event of a hydraulic line sever or failure. Counter balance valves generally prevent valves from opening on their own due to hydraulic failure but may itself be susceptible to failure.

In operation, a dart, such as dart 3, would be dropped from a satellite tube 124 through the axial bore 104 to a dart drop area generally comprising the area immediately above the first gate 602. The empty satellite tube 124 would be left above the axial bore 104. The safety assembly 122 or blanking assembly would be located above the empty satellite tube 124. The typical procedure is to then load the upper remote 602 such that the dart drops from the dart drop area to the dry block and close the upper remote 602 prior to launching the dart. If by either system or operator error, the launch remote 604 is opened prior to closing the upper remote 602, pressure from fracturing operations of the wellbore could drive the dart upwards back towards the satellite tube 124. In this case, the safety assembly 122 would then stop the dart from passing therethrough. Another possibility is that the dry block 606 is equalized with pressure or positively pressurized higher than the pressure from fracturing operations but the upper remote 602 is opened by system or operator error. The safety assembly 122 would once again stop the dart.

Although embodiments have been described above with reference to the accompanying drawings, those of skill in the art will appreciate that variations and modifications may be made without departing from the scope thereof as defined by the appended claims.

What is claimed is:

1. A satellite launcher for delivering satellites into a wellbore comprising:

a body comprising a planar surface and an axial bore extending through the planar surface, the axial bore in communication with the wellbore;

a plurality of satellite tubes, each satellite tube for releasably retaining a satellite and having an open end for facing the planar surface;

a first track system comprising:

a first track extending along the planar surface through the axial bore, the first track defining a first track opening at the axial bore, a first magazine slideably attached to the first track and movable along the first track, the first magazine for detachably retaining two or more of the satellite tubes, and a first drive system for moving the first magazine along the first track; and a second track system comprising:

a second track extending along the planar surface through the axial bore, wherein the second track is angularly offset from the first track relative to the axial bore, the second track defining a second track opening at the axial bore, a second magazine slideably attached to the second track and moveable along the second track, the second magazine for detachably retaining two or more of the satellite tubes, and a second drive system for moving the second magazine along the second track, wherein when one of the satellite tubes is aligned with the axial bore, the satellite contained therein is free to drop out of the satellite tube.

2. The satellite launcher of claim 1 further comprising a deployment system between the satellite launcher and the wellbore, the deployment system comprising a first actuator to selectively allow a satellite from a satellite tube to enter the wellbore.

3. The satellite launcher of claim 2, wherein the deployment system comprises a second actuator to selectively allow a satellite having passed the first actuator to enter the wellbore.

4. The satellite launcher of claim 2, wherein the deployment system further comprises a small pressure pump for equalizing pressure between the deployment system and the wellbore.

5. The satellite launcher of claim 1, wherein the first track system and the second track system each comprise a guide rail for assisting the retention of satellite tubes.

6. The satellite launcher of claim 1, wherein the first track system and the second track system each comprise a frame structure for assisting the retention of satellite tubes.

7. The satellite launcher of claim 6, wherein the frame structures each comprise a safety assembly comprising a blanking cap.

8. The satellite launcher of claim 1, wherein the first magazine comprises a first carrier and the second magazine comprises a second carrier for supporting satellite tubes.

9. The satellite launcher of claim 1, wherein the first drive system and the second drive system are screw drives, each screw drive comprising a hydraulic screw actuator, an activation nut and a threaded axle.

10. The satellite launcher of claim 1, wherein the first drive system and the second drive system are screw drives, each screw drive comprising a hydraulic screw actuator, a hydraulic motor and a threaded axle, wherein the hydraulic motor comprises a hydraulic stop valve operative to stop a flow of hydraulic fluid to the hydraulic motor.

11. The satellite launcher of claim 9, wherein the first drive system and the second drive system comprise one or more sensors to confirm travel of the magazine along the track.

12. The satellite launcher of claim 11, wherein the sensors measure and record revolutions of the threaded axle.

13. The satellite launcher of claim 1, wherein the first drive system and the second drive system are one of chain and sprocket drives, winch and cable drives, hydraulic cylinder drives, and gear rack drives.

14. The satellite launcher of claim 1, wherein the first track system and the second track system each comprise a spring pin stop for stopping a magazine at positions along the corresponding tracks corresponding to positions where a satellite tube is aligned with the axial bore.

15. The satellite launcher of claim 1, wherein the satellite tubes are comprised of translucent plastic material.

16. The satellite launcher of claim 15, wherein the plastic material is thermally insulative.

17. The satellite launcher of claim 1, wherein each of the satellite tubes comprise a heating coil.

18. The satellite launcher of claim 1, further comprising a drop sensor to confirm that a satellite has been provided to the wellbore.

19. The satellite launcher of claim 1, wherein the satellite tubes comprise a cap on an end distal the planar surface.

20. The satellite launcher of claim 1, wherein the satellites are at least one of darts and packer balls.

* * * * *